US005314560A

United States Patent [19]

Pritchet

[11] Patent Number: 5,314,560

[45] Date of Patent: May 24, 1994

[54] BLINDED LABEL AND METHOD OF MAKING SAME

[75] Inventor: Warren A. Pritchet, Oak Ridge, N.J.

[73] Assignee: Almedica Services Corp., Waldwick, N.J.

[21] Appl. No.: 51,261

[22] Filed: Apr. 21, 1993

Related U.S. Application Data

[63] Continuation of Ser. No. 715,477, Jun. 14, 1991, abandoned.

[51] Int. Cl.[5] ..... B42D 15/00

[52] U.S. Cl. ..... 156/238; 156/230; 156/240; 156/256; 283/81; 283/102

[58] Field of Search ..... 156/240, 249, 253, 254, 156/290, 230, 238, 234, 256; 283/94, 100, 102, 903, 81

[56] References Cited

U.S. PATENT DOCUMENTS

| | | | |
|---|---|---|---|
| 2,999,698 | 9/1961 | Hoese | 283/100 |
| 3,740,081 | 6/1973 | Whipperman | 283/97 |
| 3,837,565 | 9/1974 | Johnsen | 229/68 R |
| 3,945,870 | 3/1976 | Johnsen | 156/201 |
| 4,047,996 | 9/1977 | Kanzelberger | 156/290 |
| 4,241,943 | 12/1980 | Malinovitz | 283/102 |
| 4,299,637 | 11/1981 | Oberdeck et al. | 156/64 |
| 4,637,635 | 1/1987 | Levine | 283/101 |
| 4,671,512 | 6/1987 | Bachman et al. | 273/139 |
| 4,674,771 | 6/1987 | Thompson, II | 462/66 |
| 4,677,553 | 6/1987 | Roberts | 364/412 |
| 4,787,950 | 11/1988 | Meloni etal. | 156/249 |
| 5,074,566 | 12/1991 | Desbiens | 273/269 |

*Primary Examiner*—David A. Simmons
*Assistant Examiner*—J. Sells
*Attorney, Agent, or Firm*—Laff, Whitesel, Conte & Saret

[57] ABSTRACT

A blinded sheet or label is produced from a base sheet suitable for use in blinded testing or other applications where secret information appears. The base sheet is formed from a carrier web having a release surface joined by adhesive to face stock paper preprinted with desired blocks of information. The base sheet is advanced through a hot stamp machine, where a roll of scratch-off, transferable opaque laminate is mounted for simultaneous advancement through the hot stamp machine. The hot stamp machine is programmed to apply heat and pressure through a reciprocating platen containing a transfer die to the opaque laminate roll and base sheet at a selected location along the base sheet, causing the opaque laminate to transfer to the base sheet over the secret block of information. The reciprocating platen then moves away from the base sheet so that it and the opaque laminate roll can advance for the process to repeat itself over another secret block of information.

5 Claims, 3 Drawing Sheets

BLINDED LABEL AND METHOD OF MAKING SAME

This application is a continuation of application Ser. No. 7/715,477, filed Jun. 14, 1991, abandoned.

This invention relates to labels and more particularly to labels used in the blinded testing of pharmaceutical and other products. In blinded testing, the identity of the product being tested needs to be kept secret from either the administrator of the test or the participant in the test or both, but the information on the label, including the identity of the product or products contained in such a test, must be readily available to the persons conducting the test.

BACKGROUND OF THE INVENTION

Keeping secret the identity of products involved in various kinds of testing while, at the same time, having such product labelled in such a manner that the product (and all its components, if applicable) is readily identifiable when such information is required has been a longstanding problem. This aspect of secrecy in testing is frequently referred to as "blinding."

In order to solve this problem, various types of label blinding techniques have been devised where the area of the label which describes the full contents of the container or package has been covered with a form of removable opaque material. To date, such labels have included: manufactured products that consist of multilaminants with a pasted pocket using carbon spot and/or carbonless paper to transfer an image into a secret pouch (like a payroll envelope); products in which the secret information is located inside a sealed-pasted pouch by use of clever folding techniques; overlays using removable pressure-sensitive labels; and products where an alcohol wipe or cotton swab soaked with alcohol would be used to wipe away an alcohol-soluble ink which had been printed over the information about the contents of the package. Techniques have also been used where a base sheet is preprinted with the information about the container's contents and an opaque paper cover is heat-sealed over the information on either a continuous form basis or on an individual label basis using unique heat sealing machinery. Opaque material is sometimes screen printed on a label, but it often peels and cracks and is generally too sensitive to abrasion with this process.

Generally, manufacturing of the labels requires special materials with relatively long production lead times. The blinded label manufacturing processes are slow, do not permit individual labels to be precut, and require considerable labor and manual intervention in two to three production steps.

The security and secrecy associated with these various types of blinding labels are reduced when the information on them is applied using computer-driven printing techniques. The printers leave impressions, such as with daisy wheel printers and dot matrix printers, or they deposit ink with ink jet printers or with powdered pigment which is fused onto the paper with a heating element (as with laser printers). When someone is determined to access the blinded information, the surface impressions made by impact printing can be made to reveal the encrypted information. Similarly, laser printed characters are raised above the surface of the paper to which they are adhered. Close observance of these surface deposits and their resultant patterns can effectively decode a hidden message. These problems discourage the use of computer-driven printing techniques, requiring resort to slower and more costly printing techniques.

In certain types of testing where knowledge of the contents of the package is not critical (e.g., comparative testing of laundry detergents), the information about the contents could be simply coded. Pharmaceuticals, however, generally require labels having a complete description of the contents of the container to which they are attached in order to comply with all state and federal laws and regulations. A complete description of the product must be maintained for days in interstate commerce.

There is a need for, and the objects of the invention are to provide, a label and a method to produce that label such that: (a) the label contains the complete description of the contents of the container or package; (b) the blinding process and materials used do not allow the blind to be broken by observing the impressions or surface deposits left by the printer; (c) if someone does attempt to break the blind, evidence of such tampering is readily apparent; (d) the blind may easily be broken when it is appropriate to do so; (e) large quantities of labels meeting these criteria may be produced quickly and cost effectively and with minimal labor requirements; and (f) different configurations of labels and different configurations of the secret areas contained thereon can be easily blinded.

BRIEF SUMMARY OF THE INVENTION

In keeping with an aspect of the invention, these and other objects are accomplished by affixing a face stock sheet to a continuous carrier web with a releasable adhesive layer. The face stock may be die cut in the desired size and shape for the ultimate label, and the desired blocks of information may be printed on the face stock using computer-driven printers or other conventional printers. The carrier web is marginally perforated to facilitate computer-driven printers and for sprocket advancement during the printing and opaquing processes. The resulting carrier web/face stock combination forms a base sheet which can be driven through a hot stamp machine. The hot stamp machine has a roll of transferable opaquing laminate rotatably mounted thereon. As the base sheet and opaquing laminate roll pass through the hot stamp machine, a reciprocating head with attached die chase platen applies heat and pressure to the aligned opaquing laminate and base sheet, causing the opaque material to transfer to the base sheet over the secret block of information, obscuring it from view. The head then moves away from the base sheet, and the base sheet and opaquing laminate roll each advance to bring the next secret block of information on another label into position for the process to repeat itself. The resulting opaqued continuous sheet of labels may be stored or transported intact until they are individually peeled away from the carrier web for use.

BRIEF DESCRIPTION OF THE DRAWINGS

A preferred embodiment of the invention is shown in the attached drawing wherein.

DETAILED DESCRIPTION OF A PREFERRED EMBODIMENT

Figure 3:
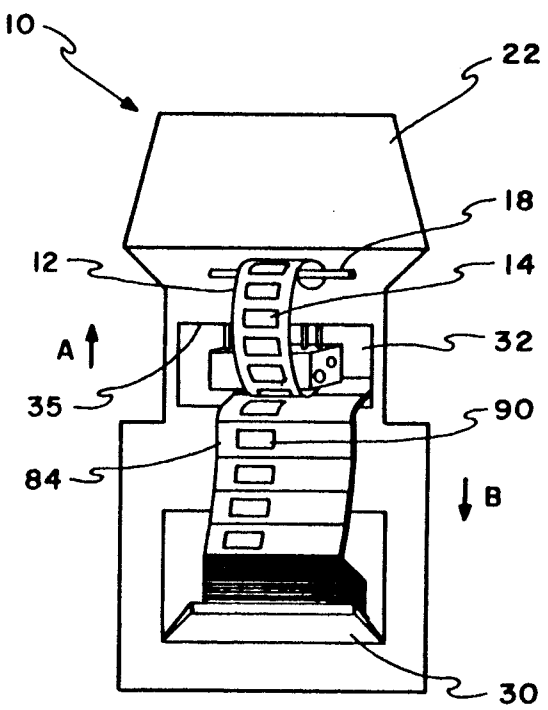
FIG. 3 is a rear elevation view of a hot stamp machine applying the opaquing material to the base sheet.
Figure 2:
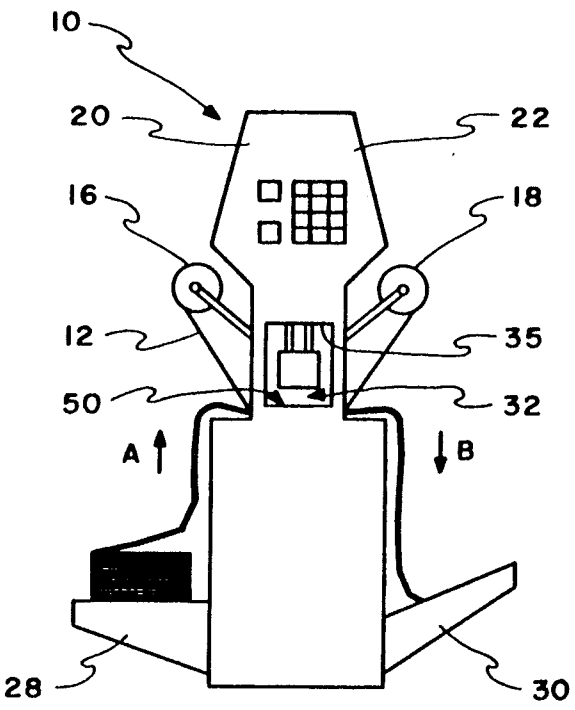
FIG. 2 is a side elevation view of a hot stamp machine applying the opaquing material to the base sheet.
Figure 1:
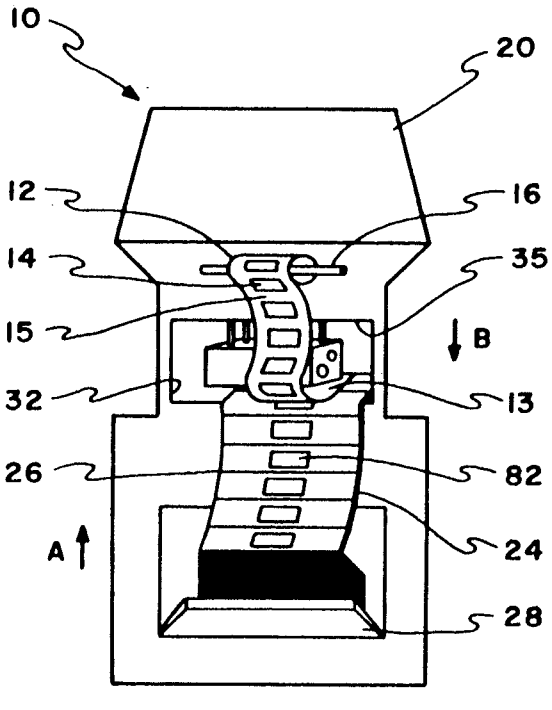
FIG. 1 is a front elevation view of a hot stamp machine applying the opaquing material to the base sheet.

FIGS. 1-3 show a hot stamp machine 10 used for producing labels made in accordance with the teachings of this invention. One suitable hot stamp machine is the Xpress Model No. 2 available from Acromark Graphics Division of Berkeley Heights, N.J. Attached to the hot stamp machine 10 is a web of clear acetate or polyester film 12, which desirably is less than 2 mil thick. One surface 15 of the film 12 is coated with scratch-off roll leaf opaquing laminate material. A suitable opaquing material is available from Crown Roll Leaf Inc. of Patterson, N.J. The opaquing material 14 is continuously applied to the film 12. Preferably, the opaquing material has a printed image or multi-color pattern on it, for additional obscuring effect. The film 12 is mounted on the hot stamp machine with a pair of rotatable spools 16, 18 located on the front 20 and rear 22 sides, respectively, of the hot stamp machine 10. Spool 16 is a take-up spool, while spool 18 is a supply spool. The spools are motor-driven to permit controlled advancement.

Near the bottom of the hot stamp machine 10 is base sheet 24 which has preferably been formed so that it fan folds along fold lines 26, and it is also cut so that it can later be divided into separate, peelable labels of the desired size and shape. Alternatively, base sheet 24 could be in continuous roll form instead of in fan folded form. In either case, base sheet 24 is marginally perforated, continuous paper preprinted with the desired label information. As used herein, the term "continuous" as applied to paper or film means a sheet of predetermined width and indeterminate length. The perforations (not shown) permit the base sheet 24 to be automatically and electro-mechanically advanced with the sprockets (not shown) on the hot stamp machine from its supply ledge 28 on the front side 20 of hot stamp machine 10 in the direction shown by arrow A in FIG. 1. The base sheet 24 moves through the hot stamp machine 10 to its receiving ledge 30 located on the rear side 22. In FIG. 3, base sheet 24 is moving in the direction of arrow B. As the base sheet 24 advances through the hot stamp machine, it passes the film 12 which is moving in the direction of arrow B in FIG. 1 and in the direction of arrow A in FIG. 3.

Figure 4:
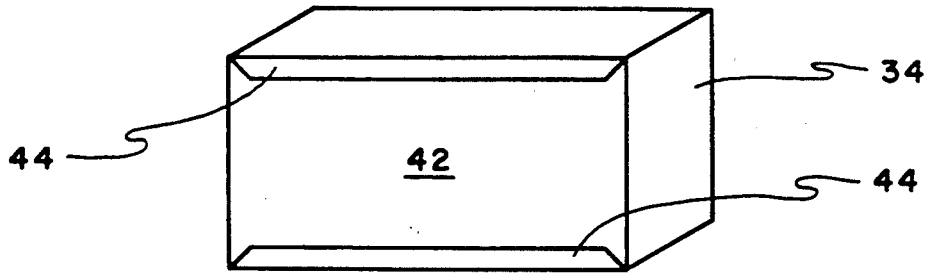
FIG. 4 is a bottom perspective view of the head of the hot stamp machine.
Figure 5:
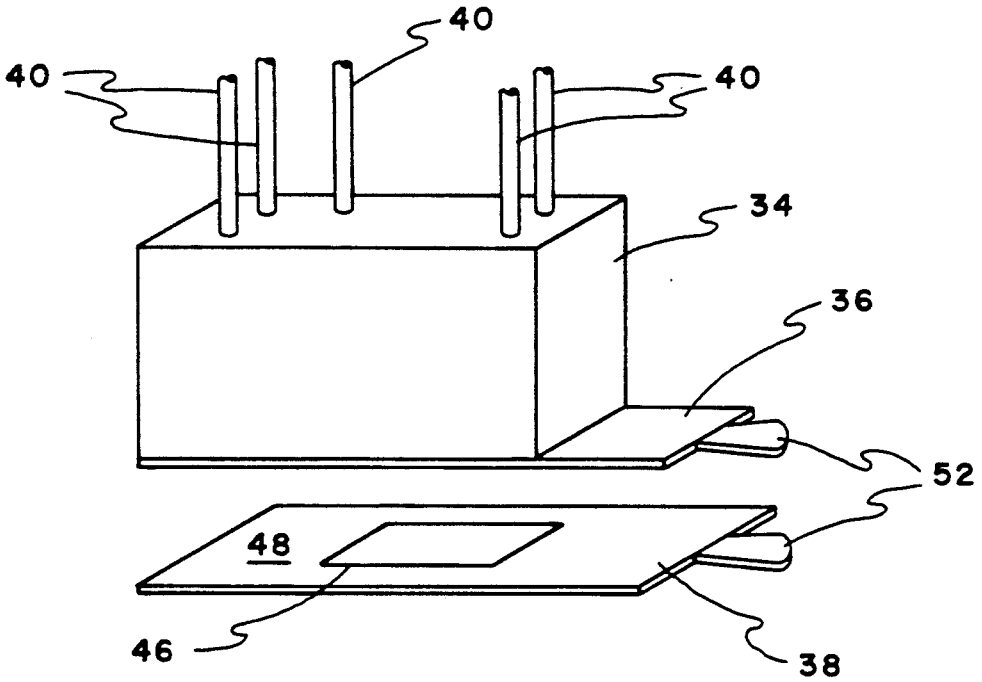
FIG. 5 is a side perspective view of the head and platens of the hot stamp machine.
Figure 6:
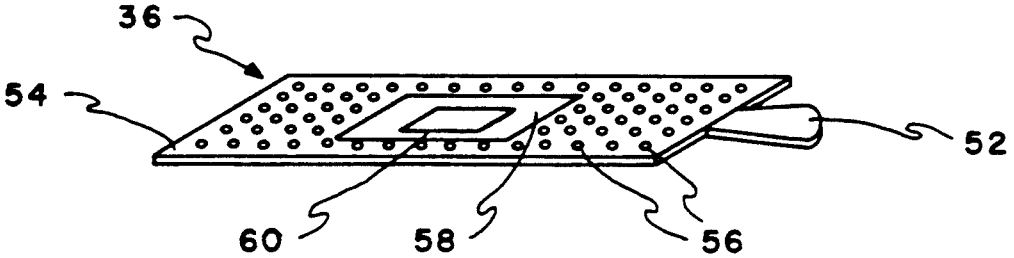
FIG. 6 is a bottom perspective view of the die chase platen.

The base sheet 24 and film 12 pass parallel to each other in the stamping cavity 32 centrally located in hot stamp machine 10. Within the stamping cavity 32 are a stamping head 34 and a pair of platens 36, 38 (FIGS. 4-6). The stamping head 34 is mounted on legs 40 for reciprocal movement from the top surface 35 of cavity 32. The inner or bottom side 42 of head 34 includes a pair of flanges 44 extending along two edges of inner side 42 and running parallel to the surfaces of the advancing base sheet 24 and film 12 moving beneath the head. The flanges 44 extend below side 42 a sufficient distance to permit die chase platen 36 to slide between them along side 42. Die chase platen 36 is preferably constructed in plate form of a rigid material which easily transfers heat, such as steel.

Also within stamping area 32, but spaced apart from and opposite die chase platen 36, is base platen 38. Like platen 36, base platen 38 is constructed in plate form of a rigid material with good heat transference characteristics, such as steel. Platen 38 has a centrally located target plate 46 on its inner surface 48 composed of a phenolic or polyurethane material for dissipating the shock or vibration which occurs when die chase platen 36 moves toward base platen 46, as described hereafter. Platen 38 is fixed on the lower surface 50 of stamping cavity 32 (FIG. 2). Both platens 36 and 38 have handles 52 at their respective ends for easier positioning.

Further construction details of platen 36 are shown in FIG. 6. The inner surface 54 of platen 36 has a plurality of screw holes 56 f or selectively positioning a transfer die plate 58 on the surface 54. Die plate 58 is also composed of a preferably rigid material with good heat transference characteristics, such as brass. The center of die plate 58 has a raised or relief surface 60 for impacting upon or embossing the opaque laminate, as described hereafter. The configuration of the transfer die plate can be varied to accommodate different configurations of labels and different configurations of secret blocks of information.

Figure 7:
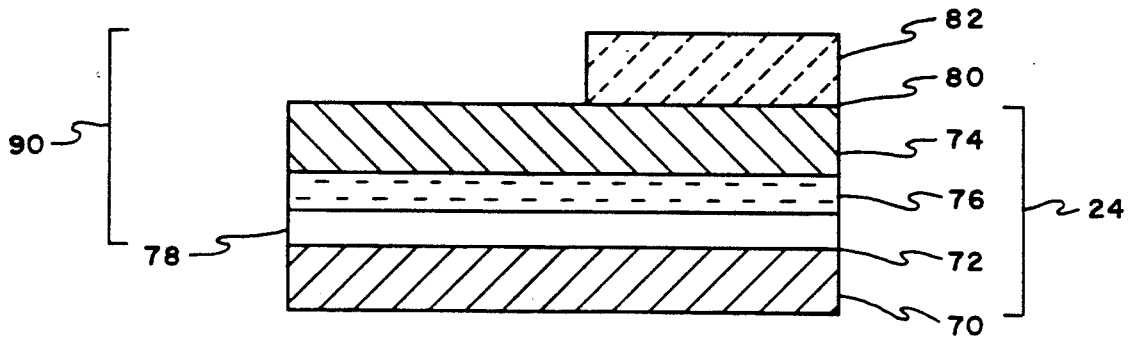
FIG. 7 is a cross section view of a label made in accordance with the invention.

Before operating the hot stamp machine 10, the base sheet 24 is prepared. As shown in FIG. 7, base sheet 24 includes a paper carrier web 70 with a silicone release coating 72 along one surface thereof. Fifty pound paper has been found to be a suitable carrier web. Base sheet 24 further includes paper face stock 74 above the carrier web 70. The underside of the face stock 74 is coated with a block-out ink or other light impervious material 76 and an adhesive layer 78. The light impervious material prevents the secret information from being viewed from the underside of face stock 74. The upper printing surface 80 of face stock 74 preferably has a gloss finish and is printed with the desired information, using a laser printer, an impact printer, or other conventional methods. One suitable face stock is white Fitchburg 60lb. having one high gloss surface, and a blue opaque coating with number 630 adhesive on the opposite surface. This face stock is available from Fitchburg Coated Products of Scranton, Pa. In FIG. 1, the increments of secret printed information to be opaqued are shown as blocks 82. Face stock 74 may be die cut into the desired label size and shape and is peelable from carrier web 70. Having thus been prepared, the base sheet 24 is loaded onto the hot stamp machine 10 as shown in FIG. 1, with the base sheet 24 threaded between the platens.

With the film web 12 containing opaquing material 14 similarly loaded on the hot stamp machine 10 and threaded to pass between die chase platen 36 and face stock 74, the hot stamp machine is ready to operate. The hot stamp machine can be programmed for particular heat and pressure settings and to advance the film 12 and base sheet 24 at the same, selected speed, stopping the advancement periodically to permit the head 34 and attached platen 36 to reciprocate relative to the film 12, base sheet 24, and base platen 38. The film 12 and base sheet 24 are aligned with the transfer die plate 58 in platen 36 so that the relief surface 60, opaque material 14, and the secret information blocks 82 are also exactly aligned. When the heated head and transfer die 58 strike the adjacent surface 13 of film 12, the opaque material 14 on the opposite surface 15 of film 12 is also heated and forced into direct contact with the adjacent surface 80 of base sheet 24. The consequent pressure between the platens 36, 38 and the controlled dwell time during which this pressure and heat are applied cause the opaque material 14 to transfer to the base sheet 24 over the information block 82, obscuring it from view. The head 34 is then reciprocated away from platen 38, and the base sheet 24 and film 12 are incrementally advanced to repeat the opaquing process as before with another information block. The face stock 74 now has an opaqued layer attached to it, and the combination constitutes a label 90 ready to be peeled from carrier web 70, as shown in FIG. 7. The labels 90 exit the hot stamp cavity 32 still attached to the carrier web 70 as a continuous roll or sheet of labels 84 for collection on receiving ledge 30, as shown in FIG. 3.

Figure 8:
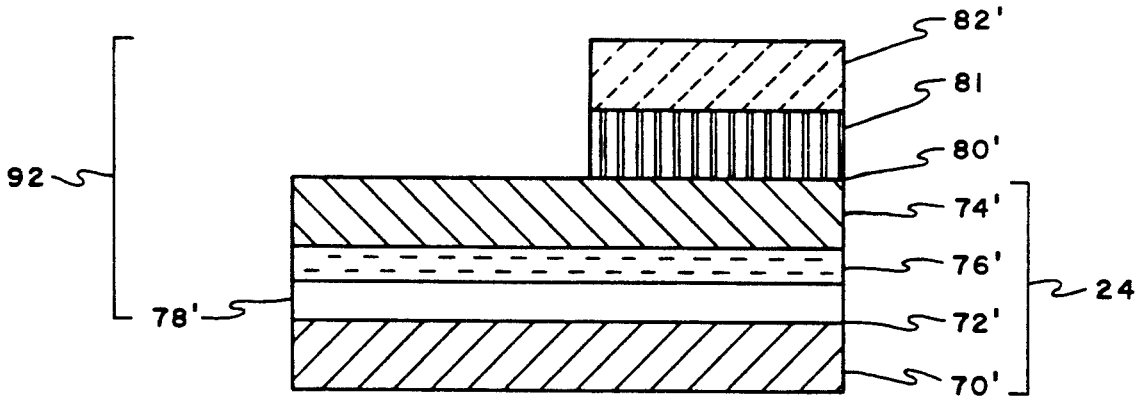
FIG. 8 is a cross section view of a second embodiment of a label made in accordance with the invention.

An alternative label 92 is shown in FIG. 8. Label 92 is mounted on peel-off paper carrier web 70' coated with a silicone release coating 72'. Above the carrier web 70', label 92 includes an adhesive layer 78', a layer of block-out ink or other light impervious material 76', and paper face stock 74'. The upper surface 80' of face stock 74' is printed with the desired secret information, but unlike label 90, surface 80' does not contain a high gloss finish. Instead, surface 80' is laminated with a transparent roll leaf 81 using the hot stamp machine to apply heat and pressure. Thereafter, the opaquing material 82' is applied with the hot stamp machine as before. Label 92 is produced when face stock having a matte finish is preferred. The transparent roll leaf layer 81 provides a suitable base for the opaquing material.

The settings for the hot stamp machine vary with the formulation of the opaquing material, the type of face stock used, and the size of the area to be opaqued. With the paper found suitable as described herein and for a two square inch area, a heat setting of 292° F., a pressure setting of 75 psi, and a 0.40 second dwell time were found sufficient.

There are numerous advantages to the invention. The resulting blinded labels obscure the secret information, but the opaquing material can be easily scratched off with a coin or the edge of various instruments or tools. Once scratched, it is apparent that the label's security has been breached. The labels can be supplied in continuous form or divided and supplied singly. The continuous, attached format of the labels permits easy and high-speed computer printing without the danger of loose labels being accidentally intermixed to confuse drug identifications or patient code numbers. The continuous forms can be transported as a unit to the packaging-/labelling area for manual, semi-automatic, or automatic label application. The labels can be custom die cut in the exact desired shape prior to blinding and thus avoid any further cutting and handling operations, which reduces costs substantially. The permanent portions of the final blinded labels can be separated from the flag portions and attached to a bottle or package without cracking the opaque material, while the flag portion of the labels with the opaque material intact can be flatly placed in a case record book. The book pages therefore also lie flat and may be easily photocopied or faxed. The blinding process may be applied to items other than labels, such as lottery tickets, contest forms, or pages containing secret information. The blinding process could also be applied to discontinuous base sheets, such as a single label, or cut base sheets containing one or more labels, each fed between the platens 36, 38.

While the principles of the invention have been described above in connection with specific apparatus and applications, it should be understood that this description is made only by way of example and not as a limitation on the scope of the invention.

I claim:

1. A process for producing labels suitable for use in blinded testing, comprising:

(a) printing desired information on a printing surface of a base sheet at incremental locations along its length, said printing surface having a gloss finish;

(b) advancing said base sheet into a hot stamping machine at a predetermined rate;

(c) advancing a web containing heat and pressure transferable, scratch-off opaquing hotstamp foil into a hot stamping machine at the same predetermined rate; and (d) applying said hotstamp foil to said printing surface of said base sheet by compressing and heating said base sheet an said web with sufficient heat and pressure from said hot stamping machine to transfer said hot stamp foil from its web directly to said printing surface of said base sheet over an increment of information.

2. The process of claim 1 including the preliminary step of assembling said base sheet by combining a carrier web having a top surface with a release coating, and a face stock having a bottom surface with an adhesive layer, said top surface of said carrier web being releasably secured to said bottom surface of said face stock, and wherein the top surface of said face stock provides said printing surface of said base sheet.

3. The process of claim 1 wherein said base sheet and said opaquing laminate web are compressed and heated between a pair of platens.

4. The process of claim 2 including the additional step of die cutting said face stock before it is combined with said carrier web.

5. The process of claim 1 wherein said base sheet is continuous.

* * * * *